United States Patent [19]

Eriksson et al.

[11] Patent Number: 4,936,874

[45] Date of Patent: Jun. 26, 1990

[54] METHOD OF MANUFACTURING A GAS SUITABLE FOR THE PRODUCTION OF ENERGY

[75] Inventors: Sven Eriksson, Falun; Sven Santén, Hofors, both of Sweden

[73] Assignee: SKF Steel Engineering AB, Hofors, Sweden

[21] Appl. No.: 129,120

[22] Filed: Dec. 4, 1987

[30] Foreign Application Priority Data

Dec. 4, 1986 [SE] Sweden ..... 8605211

[51] Int. Cl.[5] ..... C10J 3/19; C10K 1/20

[52] U.S. Cl. ..... 48/203; 48/210; 252/373

[58] Field of Search ..... 48/197 R, 202, 206, 48/203, 210; 252/373

[56] References Cited

U.S. PATENT DOCUMENTS 4,056,483 11/1977 Baron et al. ..... 48/206

4,082,520 4/1978 Baron et al. ..... 48/202

*Primary Examiner*—Peter Kratz

*Attorney, Agent, or Firm*—Armstrong, Nikaido, Marmelstein, Kubovcik & Murray

[57] ABSTRACT

The present invention relates to a method of manufacturing a gas suitable for the production of energy, out of coal. The coal is gasified in counterflow with air-blast in a gasifier, and the gas generated is then mixed with a gas containing oxygen, in a ratio such that the quotient $CO_2/CO$ in the resultant gas does not exceed 0.1, in order to crack tar substances occurring in the gas. The gas is thereafter introduced into a dolomite or lime shaft for removal of sulphur compounds, any remaining tar substances and to gasify any accompanying coal particles not yet gasified.

4 Claims, No Drawings

METHOD OF MANUFACTURING A GAS SUITABLE FOR THE PRODUCTION OF ENERGY

TECHNICAL FIELD

The present invention relates to a method of manufacturing a gas suitable for the production of energy by gasifying coal in counterflow with air in a shaft, in order to generate a gas having a temperature of about 500° C. and, besides $H_2$, CO and $N_2$, containing sulphur compounds and tar substances, said gas being subjected to processes to remove the tar substances before being conducted through a dolomite or lime shaft to remove the sulphur compounds.

BACKGROUND

The use of coal for the production of energy is greatly impeded by the serious environmental factors associated with combustion of coal. The main problem is the discharge of acidifying substances such as sulphur and nitrogen oxides. Attempts have been made to a certain extent to solve this problem by various scrubbing steps but these entail a considerable increase in costs and it is extremely difficult or impossible with conventional technology to achieve the degree of purification which will be demanded if coal is to be accepted as a leading raw product for energy.

These problems can be solved by first gasifying the coal and then producing energy by combustion of the gas generated. It is relatively easy to achieve a high degree of purification, i.e. more than 95%, of sulphur in the reducing coal-gas and since the combustion is then of a gaseous fuel it can be arranged so that considerably less nitrogen oxide is formed than is possible with solid or liquid fuels. Gasification also offers better solutions to several other environmentally detrimental effects of coal combustion such as the discharge of mercury, polyaromatic hydrocarbons, heavy metals and flying ash.

Considerable effort has been made recently to develop the coal gasification method for producing energy, but in all cases costs have proved all too high. The main reason for this is the vast consumption of oxygen gas, in view of the high investment costs and relatively high consumption of electricity entailed in producing the oxygen gas. Furthermore in most coal-gasifiers 10–20% of the gas formed is burned in the gasification reactor in order to meet the heat requirement for gasification and to achieve a favourable reaction temperature.

Simple and inexpensive methods of manufacturing gas suitable for the production of energy are coal-gasification processes using air and consuming a minimum of coal. Coal substantially in lump form is gasified in counterflow with hot air-blast in the shaft furnace. The gas formed has a temperature of approximately 500° C. and thanks to the low temperature, includes reasonable quantities of tar substances and small amounts of uncombusted coal in particle form.

As revealed in Swedish patent applications 85 04 439-4 and 85 04 440-2 same applicant, it has been proposed to thermically crack hydrocarbons occuring in a gas produced by gasification of coal, by supplying a gas heated by plasma-generator. After partial cracking, the gas is conducted through a dolomite filter of the type used in the Wiber-Söderfors process. Complete cracking of the remaining tar substances is obtained during transport through the filter, and the gas is purified from sulphur at the same time. One object of the invention is to further improve the technology proposed in the above-mentioned patent applications by further reducing the consumption of electricity.

CHARACTERIZATION OF THE INVENTION

The method according to the present invention is based on the technique stated in the preamble herein, and is characterised in that the gas leaving the shaft is introduced into a chamber together with a gas containing oxygen, to at least partially crack tar substances occurring in the gas, the quantity of oxygen added being so adjusted that the quotient $CO_2/CO$ in the resultant gas does not exceed 0.1, a temperature of 900°–1200° C. being maintained in said chamber and the gas thereafter being introduced into the dolomite or lime shaft for removal of sulphur compounds and any remaining tar substances, and to gasify any accompanying coal particles.

According to one embodiment of the invention energy is supplied to the reaction chamber in order to achieve a temperature favourable to cracking. This may be done by pre-heating the oxygenous gas before its entry into the chamber. The energy is preferably supplied partly by pre-heating of the oxygenous gas and partly by partial combustion in the chamber.

The oxygenous gas is preferably air or oxygen-enriched air.

The temperature interval is essential to provide cracking without melting, and the gas quotient is essential in view of sulphur purification and, of course in view of energy density for the gas produced.

Additional advantages and characteristics of the invention will be revealed in the following description and the invention is also illustrated below with the aid of an example.

EMBODIMENTS

The gasification shaft is of the gas-generator type in general use, particularly in England, during the first half of the twentieth century. These gas generators were fueled entirely by coal in lump form and supplied a fuel gas with extremely high tar content. In our design the generator is operated by hot air-blast and the coal ash is therefore melted to a liquid slag as well as enabling a part of the coal to be in the form of coal dust if the altered heat balance is compensated by the blasting temperature. Converting the coal ash to slag offers a high coal yield since negligible quantities remain in the slag, the volume of ash is greatly reduced and leaching rates are considerably lower.

Another advantage gained by converting the coal ash to slag is that the addition of slag-former can be used to control the composition of the ash for the manufacture of raw products for cement, for instance. A drawback with this type of gasifier is that not all types of coal are suitable for counterflow-gasification with a slow temperature increase. This applies primarily to coal which is converted to liquid form upon heating or coal which "explodes" into small particles. This is partially compensated by 70% of the raw coal product being injectable in the form of fines and the limitations described above do not apply to this percentage.

The gas from the generator shaft is mixed with air in order to meet the oxygen requirement for cracking the tar substances. The air is preferably pre-heated to avoid too high a content of $CO_2$ in the gas since this will lead to poorer effect at the subsequent sulphur purification. However, part of the energy requirement can be covered through partial combustion in the chamber. The quotient of $CO_2/CO$ should not exceed 0.1, to give an indication of the quantity of $CO_2$ which can be permitted in the gas.

The temperature in the chamber should lie within the interval 900°–1200° C., preferably about 1100° C.

Mixing and temperature increase thus take place in one step in a mixing chamber in direct conjunction with the desulphurizing shaft in which the gas then remains for a sufficient time to allow complete cracking and purification from sulphur. The sulphur filter is of the tried and tested type used in the Wiber-Söderfors process for removing sulphur from the reduction gas. According to measurements performed in this process on comparable gases, the sulphur contents in the gas discharged remain steadily at 20–30 ppm, while the dolomite is utilized fully to a depth of about 6 mm if the gas remains in the shaft for about 36 hours. The main reason for the full temperature increase in gas entering the filter not being taken up by partial combustion of the gas is that the gas would then acquire a higher oxygen potential, thus deteriorating the conditions for sulphur purification. The great advantage with sulphur purification where the sulphur-purifying agent is in solid phase (instead of in the form of a slag, for instance) is that the CaO activity remains close to one, thus giving more complete sulphur purification and decreased consumption of the sulphur-purifying agent.

Besides the tar substances, the gas leaving the gasification shaft also contains varying quantities of fine coal particles. These are caught in the sulphur-purifying shaft and, since the gas is slightly oxidizing (approx 5% $CO_2+H_2O$), they will be gasified slowly and the dolomite is therefore practically free from coal when it is fed out. The combination of converting the ash to slag and cracking in dolomite filters thus result in almost 100% coal yield.

The sulphur purifier in the filter is raw dolomite which is burnt in the upper portion of the shaft. This gives an addition of hardly 1% and reduces the gas temperature 50°–75° C. so that it leaves the filter at about 1000° C. The purified gas undergoes heat-exchanging with the air-blast entering and leaves the gasification plant at about 650° C. The gasifier is designed to work within a pressure range of 0–3 bar overpressure, depending on the use to which the gas is to be put.

The gas produced has a thermal value of about 4,6 $MJ/m^3N$. The flame temperature and quantity of exhaust per energy unit are close to the values reached at normal combustion of oil with air. The gas must therefore be deemed extremely suitable for the production of energy.

EXAMPLE

Coal is gasified in a shaft in counterflow with preheated air-blast. Analysis of the coal gives the following composition:

| | |
|---|---|
| C | 75.9% |
| M | 4.3% |
| O | 9.4% |
| N | 1.3% |
| S | 0.5% |
| Ash | 8.6% |
| Moisture | 4% |

The gas from the shaft has a temperature of 500° C. and the following composition:

| | |
|---|---|
| $C_nH_m$ | 6.5% |
| $CO_2$ | 1.8% |
| $H_2O$ | 1.4% |
| CO | 30.0% |
| $N_2$ | 60.2% |
| $H_2S$ | 0.1% |

Stoichiometrically 29.3 $m^3N$ air per 100 kg coal is required to crack all the hydrocarbon in the gas to CO and $H_2$.

The temperature of the gas leaving the dolomite shaft after the mixing chamber is about 1000° C., and its composition is as follows:

| | |
|---|---|
| $CO_2$ | 0.3% |
| $H_2O$ | 0.1% |
| $H_2$ | 12.0% |
| CO | 32.0% |
| $N_2$ | 55.6% |

The balance between $CaO+H_2S$ and $CaS+H_2O$ governs the sulphur purification and for the stoichiometric case a ratio $H_2O:H_2S$ of 180 is obtained which gives 99% sulphur purification.

With a gas mixture in the mixing chamber having a composition corresponding to the quotient $$\frac{CO_2 + H_2O}{CO_2 + H_2O + CO + H_2} = 0.075$$

64.1 $m^3N$ air per 100 kg coal is required. The gas leaving the dolomite filter then has a temperature of about 1100° C. and the following composition:

| | |
|---|---|
| $CO_2$ | 1.9% |
| CO | 28.4% |
| $H_2O$ | 1.6% |
| $H_2$ | 9.7% |
| N | 58.4% |
| $H_2S$ | 0.009% |

In this case the degree of sulphur purification is 87.5%.

I claim:

1. A method of manufacturing a gas suitable for the production of energy comprising gasifying coal in counterflow with air in a shaft to obtain a gas having a temperature of about 500° C. and containing $H_2$, CO and $N_2$, sulphur compounds and tar substances, introducing the gas leaving the shaft into a chamber together with a gas containing oxygen, to partially crack tar substances occurring in the gas, the quantity of oxygen added being so adjusted that the quotient $CO_2/CO$ in the resultant gas does not exceed 0.1, a temperature of 900°–1200° C. being maintained in said chamber, and introducing the gas thereafter into a dolomite or lime shaft for removal of sulphur compounds and remaining tar substances, and to gasify any accompanying coal particles.

2. A method as claimed in claim 1, wherein energy is supplied by the gas containing oxygen being pre-heated before its entry into the chamber.

3. A method as claimed in claim 1, wherein the oxygenous gas is air or oxygen-enriched air.

4. A method as claimed in claim 1, wherein energy is supplied partly by pre-heating of the oxygenous gas and partly by partial combustion in the chamber.

* * * * *